United States Patent [19]

Okayasu et al.

[11] Patent Number: 5,003,709

[45] Date of Patent: Apr. 2, 1991

[54] PRICK-PREVENTING SHOE

[75] Inventors: Kenji Okayasu, Gyoda; Hideo Okayasu, Tokyo, both of Japan

[73] Assignee: Rikio Co., Ltd., Gyoda, Japan

[21] Appl. No.: 462,989

[22] Filed: Jan. 10, 1990

Related U.S. Application Data

[63] Continuation of Ser. No. 176,231, Mar. 31, 1988, abandoned.

[51] Int. Cl.[5] ..... A43B 13/42; A43B 13/10

[52] U.S. Cl. ..... 36/107; 36/108; 36/44

[58] Field of Search ..... 36/107, 108, 44, 74 C, 36/85, 30 R, 97, 132; 148/403; 428/658

[56] References Cited

U.S. PATENT DOCUMENTS

| | | | |
|---|---|---|---|
| 1,637,565 | 8/1927 | Gordon | 36/132 |
| 1,685,538 | 9/1928 | Glidden et al. | 36/44 |
| 2,049,604 | 8/1936 | Cristallini | 36/108 |
| 3,989,517 | 11/1976 | Tanner et al. | 148/403 |
| 4,026,045 | 5/1977 | Druss | 36/108 |
| 4,133,682 | 1/1979 | Ray | 148/403 |
| 4,271,607 | 6/1981 | Finck | 36/107 |
| 4,404,757 | 9/1983 | Sweeney | 36/76 C |

FOREIGN PATENT DOCUMENTS

| | | | |
|---|---|---|---|
| 3536728 | 4/1986 | Fed. Rep. of Germany | 428/658 |
| 48-95 | 2/1923 | Japan . | |
| 3217 | 3/1936 | Japan . | |
| 28-11940 | 11/1953 | Japan . | |
| 30-37 | 1/1955 | Japan . | |
| 45-1150 | 1/1970 | Japan . | |
| 52-47952 | 4/1977 | Japan . | |
| 53-99243 | 8/1978 | Japan . | |
| 54-171947 | 12/1979 | Japan . | |
| 55-94201 | 7/1980 | Japan . | |
| 57-112801 | 7/1982 | Japan . | |
| 57-112805 | 7/1982 | Japan . | |
| 57-112806 | 7/1982 | Japan . | |
| 57-112807 | 7/1982 | Japan . | |
| 57-112810 | 7/1982 | Japan . | |
| 58-1205 | 1/1983 | Japan . | |
| 58-62903 | 4/1983 | Japan . | |
| 58-32650 | 7/1983 | Japan . | |
| 58-32651 | 7/1983 | Japan . | |
| 58-43847 | 10/1983 | Japan . | |
| 58-168201 | 11/1983 | Japan . | |
| 59-8601 | 1/1984 | Japan . | |
| 59-37041 | 10/1984 | Japan . | |
| 61-59722 | 12/1986 | Japan . | |
| 2060350 | 5/1981 | United Kingdom | 36/107 |

*Primary Examiner*—Steven N. Meyers

*Attorney, Agent, or Firm*—Fleit, Jacobson, Cohn, Price, Holman & Stern

[57] ABSTRACT

Herein disclosed is a prick-preventing shoe, in which is sandwiched between a grounding sole and an inner sole a prick-preventing metallic core shaped to match the shape of the grounding sole and having at least its portion made of a sheet of an amorphous metal. The prick-preventing shoe has its prick prevention and flexibility compatible with each other so that it is advantageous to enjoy the spongy step accompanied by the bendability.

2 Claims, 2 Drawing Sheets

PRICK-PREVENTING SHOE

This application is a continuation of application Ser. No. 07/176,231, filed Mar. 31, 1988 now abandoned.

BACKGROUND OF THE INVENTION

1. Field of the Invention

The present invention relates to a prick-preventing shoe and, more particularly, to a prick-preventing workman's split-toed heavy-cloth shoe.

2. Description of the Prior Art

The workman's shoe of the prior art has its sole reinforced by a metal plate of steel, stainless steel or the like so that the shoe ma be prevented from being pricked by a nail or the like.

In order to increase the resistance to the prick thereby to enhance the safety, it is necessary to increase the thickness of the core of the metal plate. This increase in the thickness in turn makes it difficult for the shoe to bend so that the springy step is seriously deteriorated.

Taking both the safety and the deterioration in step into consideration, there has been proposed a workman's split-toed heavy-cloth shoe which incorporates a stainless steel plate having a thickness of about 0.3 mm for preventing the prick. This structure is a compromise between the safety and the springy step accompanied by the bending motions so that the prick prevention is neither as high as that of the safety shoe conforming to the Japanese Industrial Standards nor as bendable as the existing workman's split-toed heavy-cloth shoe.

SUMMARY OF THE INVENTION

The present invention contemplates to eliminate the above-specified drawbacks and has an object to provide a prick-preventing shoe which is intended to prevent its sole from being pricked and not to deteriorate the springy step accompanied by the bending motions, both by using a sheet of an amorphous metal.

According to the gist of the present invention, the prick-preventing shoe is characterized in that there is sandwiched between a grounding sole and an inner sole a prick-preventing metallic core which is shaped to match the shape of said grounding sole and which has at least its portion made of a sheet of an amorphous metal.

BRIEF DESCRIPTION OF THE DRAWINGS

Other objects, features and advantages of the present invention will become apparent from the following description taken in conjunction with the embodiments thereof with reference to the accompanying drawings, in which.

DESCRIPTION OF THE PREFERRED EMBODIMENTS

Figure 1:
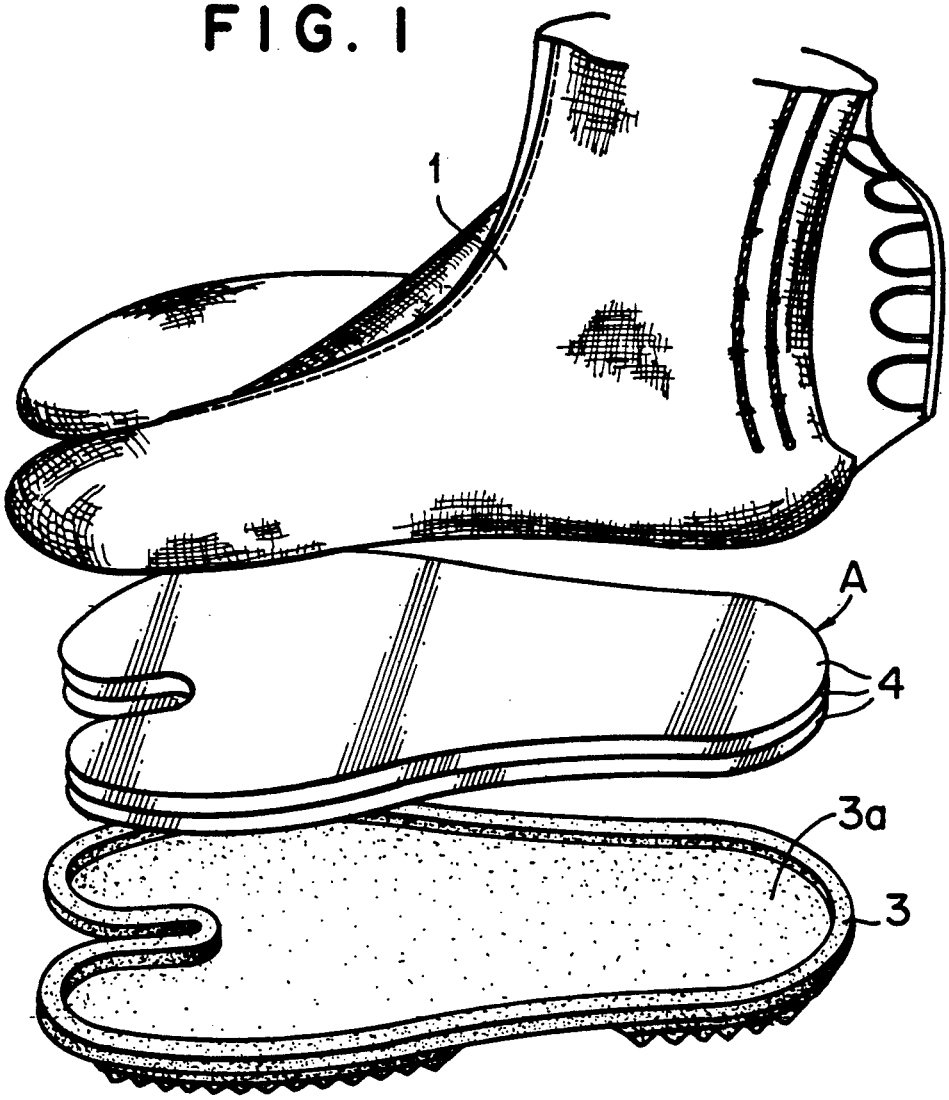
FIG. 1 is an exploded perspective view showing a portion of a prick-preventing shoe according to one embodiment of the present invention.
Figure 2:
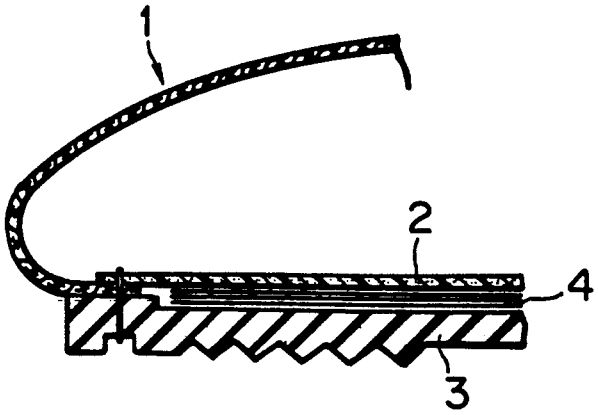
FIG. 2 is a section showing a portion of the prick-preventing shoe of FIG. 1.

In FIGS. 1 and 2: reference numeral 1 designates an upper having an inner sole; numeral 3 designates a grounding sole; and numeral 4 designates a prick-preventing metallic core. In this embodiment, the prick-preventing metallic core 4 is made in its entirety of an amorphous metal sheet A which is composed of a plurality of amorphous metal foils. Reference numeral 3*a* appearing in the drawing designates a recess which is formed in the upper side of the grounding sole 3 for fitting the metallic core 4 therein.

Generally speaking, an amorphous metal has a higher tensile strength per unit area than that of a metal having an ordinary crystal structure. For example, a similar iron alloy such as a normal stain-less steel has a tensile strength of about 50 kgf/mm$^2$, whereas the amorphous metal of an iron-chromium-manganese alloy has a tensile strength as high as 330 kgf/mm$^2$. In addition to this high strength, the amorphous metal has a high hardness so that it can exhibit an accordingly high resistance to the prick. Because of its high bendability in a foil shape, moreover, the amorphous metal is suitable for a material for the prick-preventing metal of the present invention.

The suitable amorphous metal to be used in the present invention is exemplified by those having a high tensile strength such as an iron alloy of iron-chromium-manganese or iron-boron, a cobalt alloy of cobalt-zirconium or cobalt-silicon-boron, or a nickel alloy of nickel-zirconium but should not be limited thereto. The amorphous alloy foil generally has a thickness of about 20 to 30 microns and may be used in two or more foils.

Figure 3:
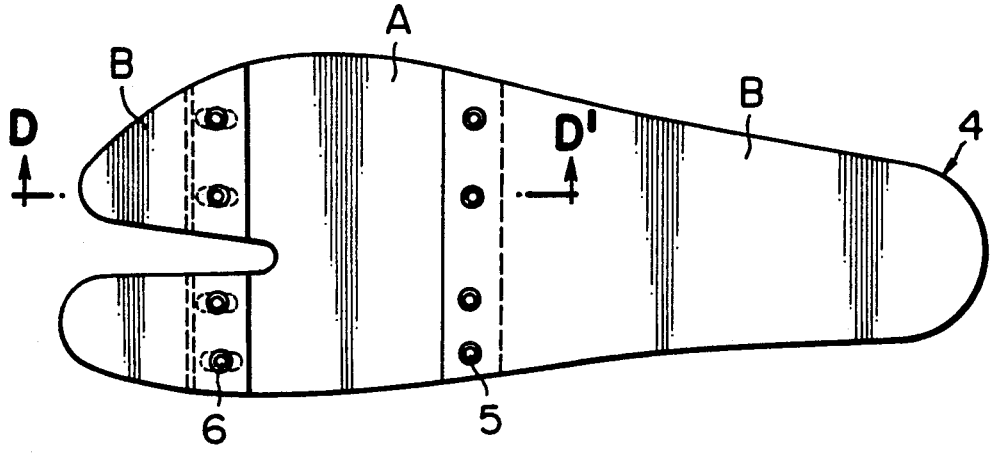
FIGS. 3 and 4 are a top plan view and a sectional view showing another example of the prick-preventing metallic core to be used in the shoe of the present invention.
Figure 4:
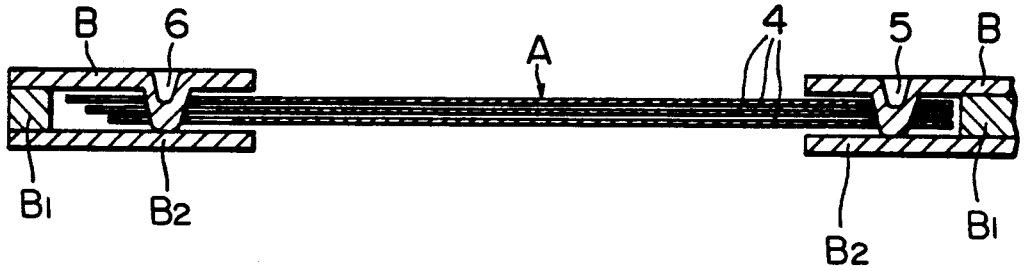

FIGS. 3, 4, 5 and 6 show another embodiment of the prick-preventing metallic core to be used in the present invention. In this embodiment, the amorphous metal sheet A is arranged only in the bending portion of the shoe. FIG. 3 presents a top plan view, and FIG. 4 presents a section taken along a line D—D of FIG. 3. Reference letters B, $B_1$, $B_2$ appearing in FIGS. 3 and 4 designates a laminate which is prepared by spot-welding or adhering three or members sheets of an ordinary metal such as stainless steel. This laminate B, $B_1$, $B_2$ is shortened at its central portion to receive the amorphous metal sheet A. Numerals 5 and 6 designate spot-welds at which the amorphous metal sheet A is sandwiched between the upper and lower metal sheets B, $B_2$.

Figure 5:
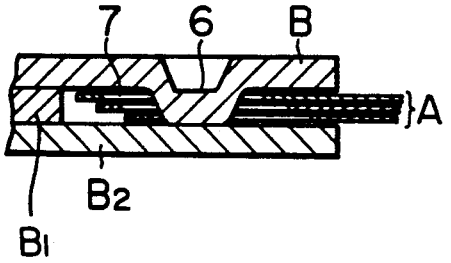
FIGS. 5 and 6 are enlarged sections showing the joints of FIG. 4.

FIG. 5 shows the spot weld 6 of the toe of FIG. 4 in an enlarged scale. As shown, the upper metal sheet B is partially bulged downward, and this bulged portion and the contacting lower metal sheet $B_2$ are electric-resistance welded.

Generally speaking, the amorphous metal has its characteristics drastically degraded when it is heated at a high temperature, so that it cannot be suitably welded to another metal. This difficulty is reduced by forming the bulged portion. In case, on the other hand, the plural foils of an amorphous metal are used in a superposed manner as in this embodiment, the amorphous metal foils are displaced from one another when the bending motions are caused.

In order to release these displacements, the individual amorphous metal foils are formed with slots 7 larger than the bulged portion, and the gap between the upper and lower metal sheets B, $B_2$ is made larger than the total thickness of the amorphous metal foils so that these foils may move freely without their mutual interference.

Figure 6:
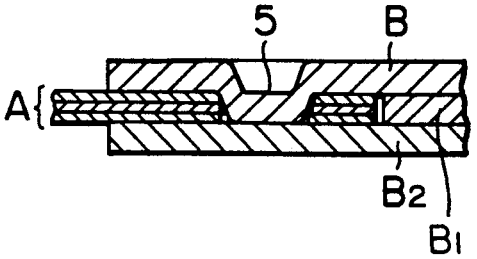

FIG. 6 is an enlarged section showing the spot weld of the amorphous metal foils and the upper and lower metal sheets at the arch of the shoe. Like the joint at the toe, a bulged portion is also formed to minimize the thermal influence upon the amorphous metal foils. At this arch, however, the upper and lower metal sheets and the amorphous metal foils are firmly jointed in an immovable manner.

Since, in these embodiments, the amorphous metal foils A are arranged only at the bending portion, the amorphous metal or a generally expensive material can be economically used without deteriorating the springy step as the shoe.

In the embodiments thus far described with reference to the drawings, the present invention is applied to the workman's split-toed heavy-cloth shoe but should not be limited thereto. It should be noted that the present invention can be applied generally to working shoes such as safety shoes.

With the structure thus far described, the prick-preventing shoe according to the present invention has its prick prevention and flexibility compatible with each other so that it is advantageous to enjoy the spongy step accompanied by the bendability.

What is claimed is:

1. A prick-preventing shoe comprising:

a grounding sole;

an inner sole;

a prick-preventing metallic core sandwiched between said grounding sole and said inner sole and shaped to match the shape of at least a portion of said grounding sole, said metallic core being composed of a plurality of amorphous metal foils slidable with respect to each other and stacked in engagement with each other; and a laminate including three metal members adhered to one another and an intermediate member of said three metal members being shortened to sandwich said metallic core between a remaining upper member and a remaining lower member of said three metal members.

2. A prick-preventing shoe according to claim 1, wherein said amorphous metal foils have slots made larger than bulged portions of the upper metal member, and wherein a gap between the upper and lower metal members is made larger than the total thickness of the amorphous metal foils so that these foils may move freely without interference with the upper and lower metal members.

* * * * *